US005085145A

United States Patent [19]

Ohta et al.

[11] Patent Number: 5,085,145

[45] Date of Patent: Feb. 4, 1992

[54] REMOTE CONTROL DEVICE FOR INK GROOVE WIDTH

[75] Inventors: Hideo Ohta, Tokyo; Yasuhiro Matsumoto, Sayama; Masaru Kurihara, Kawasaki, all of Japan

[73] Assignee: Kabushi Kaisha Tokyo Kikai Seisakusho, Tokyo, Japan

[21] Appl. No.: 649,072

[22] Filed: Feb. 1, 1991

[30] Foreign Application Priority Data

May 12, 1990 [JP] Japan ..... 2-49191[U]

[51] Int. Cl.[5] ..... B41F 1/46

[52] U.S. Cl. ..... 101/363; 101/350; 101/364

[58] Field of Search ..... 101/350, 363, 364, 365, 101/366, 367

[56] References Cited

U.S. PATENT DOCUMENTS 3,921,525 11/1975 D'Amato et al. ..... 101/365
4,123,972 11/1978 Gasparrini ..... 101/363
4,596,187 6/1986 Rüger ..... 101/365

*Primary Examiner*—Edgar S. Burr
*Assistant Examiner*—Ren Yan
*Attorney, Agent, or Firm*—Trexler, Bushnell, Giangiorgi & Blackstone, Ltd.

[57] ABSTRACT

In an ink groove to have its one face defined by the circumference of an ink fountain roller and its other face defined by an oblique assembly, to have a V-shaped section, there is disclosed a device for controlling the width of an ink groove remotely, which comprises: drive means for turning the oblique assembly, between a position for forming the ink groove, when actuated, and another position for forming none of the ink groove; and drive pressure supply means for actuating the drive means remotely.

1 Claim, 3 Drawing Sheets

REMOTE CONTROL DEVICE FOR INK GROOVE WIDTH

BACKGROUND OF THE INVENTION

1. Field of the Invention

The present invention relates to an inking device for a printing press of the type using an ink groove (or ink fountain) as an ink supply and, more particularly, to a device capable of controlling the width of the ink groove remotely, i.e., remotely bringing an oblique assembly forming the ink groove close to or apart from an ink fountain roller.

2. Description of the Prior Art

The ink groove is a thin groove of a V-shaped section having its one face defined by the circumference of the ink fountain roller and its other face defined by the oblique assembly which includes a blade adapted to be brought close to or apart from the axis of the roller circumference. The ink groove has its two ends defined by triangular side members individually protruding from the oblique assembly. Thus, the ink is reserved in the groove-shaped container which is defined by the paired side members, the oblique assembly and the circumference of the roller so that it is gradually sucked in accordance with the rotations of the roller and fed to a printing plate through ink roller groups.

Moreover, the ink groove having the structure and operation described above is positioned at the starting end of the ink supply system, i.e., not the central portion of a frame supporting the printing press but the uppermost or lowermost end of the frame (as shown in FIG. 3) and usually exists as a heavy component having a length substantially equal to the distance between the two side frames (as shown in FIG. 1). Still moreover, the aforementioned oblique assembly is so attached as to come close to or apart from the circumference of the roller so that the ink groover may be conveniently replaced by another color ink or cleaned.

As to the device for bringing the oblique assembly close to or apart from the roller circumference, both Japanese Utility Model Publications No. 36-6808 and 58-13253 have disclosed manual means using a handle, a lever and an arm/link mechanism, and U.S. Pat. No. 4,123,972 has disclosed manual means using a worm mechanism.

However, both the aforementioned oblique assembly control means of the prior art are directed to the manual mechanisms assembled directly in the oblique assembly and are disposed in the uppermost or lowermost position of the printing press, as has been described above. As the printing press is large-sized at present, the worker is obliged to take an extended position (as indicated by double-dotted lines in FIG. 3) or a leaning position (although not shown) for operating the aforementioned manual mechanisms so that his working position is liable to be unstable. As has been described hereinbefore, moreover, the oblique assembly is so heavy as to raise a problem in retaining the working safety.

SUMMARY OF THE INVENTION

An object of the present invention is to provide a device which is enabled to execute the remote controls safely, reliably and easily without obliging the worker to take an unstable position, even if the oblique assembly is heavy, when he brings the oblique assembly close to or apart from the circumference of the ink fountain roller.

In order to achieve the above-specified object, according to the present invention, there is provided, in an ink groove to have its one face defined by the circumference of an ink fountain roller and its other face defined by an oblique assembly, to have a V-shaped section, a device for controlling the width of an ink groove remotely, which comprises: drive means for turning said oblique assembly, between a position for forming said ink groove, when actuated, and another position for forming none of said ink groove; and drive pressure supply means for actuating said drive means remotely.

In order to turn the oblique assembly forming part of the ink groove between the ink groove forming position and another position, drive means such as a hydraulic cylinder is used and remotely controlled by a drive pressure such as a hydraulic pressure to extend or retract the rod of the hydraulic cylinder.

When the rod is extended, the oblique assembly is brought close to the circumference of the ink fountain roller to form the ink groove. As a result, the ink can be reserved in the ink groove and supplied to the ink fountain roller.

When the rod is retracted, the oblique assembly is brought apart from the circumference of the ink fountain roller to disassemble the ink groove so that the maintenances such as the ink replacement or the cleaning can be executed.

BRIEF DESCRIPTION OF THE ACCOMPANYING DRAWINGS

Other objects, features and advantages of the present invention will become apparent from the following description to be made with reference to the accompanying drawings, showing one specific embodiment of the present invention, in which.

DESCRIPTION OF THE PREFERRED EMBODIMENT

The embodiment of the present invention will be described in detail in the following with reference to the accompanying drawings.

Figure 3:
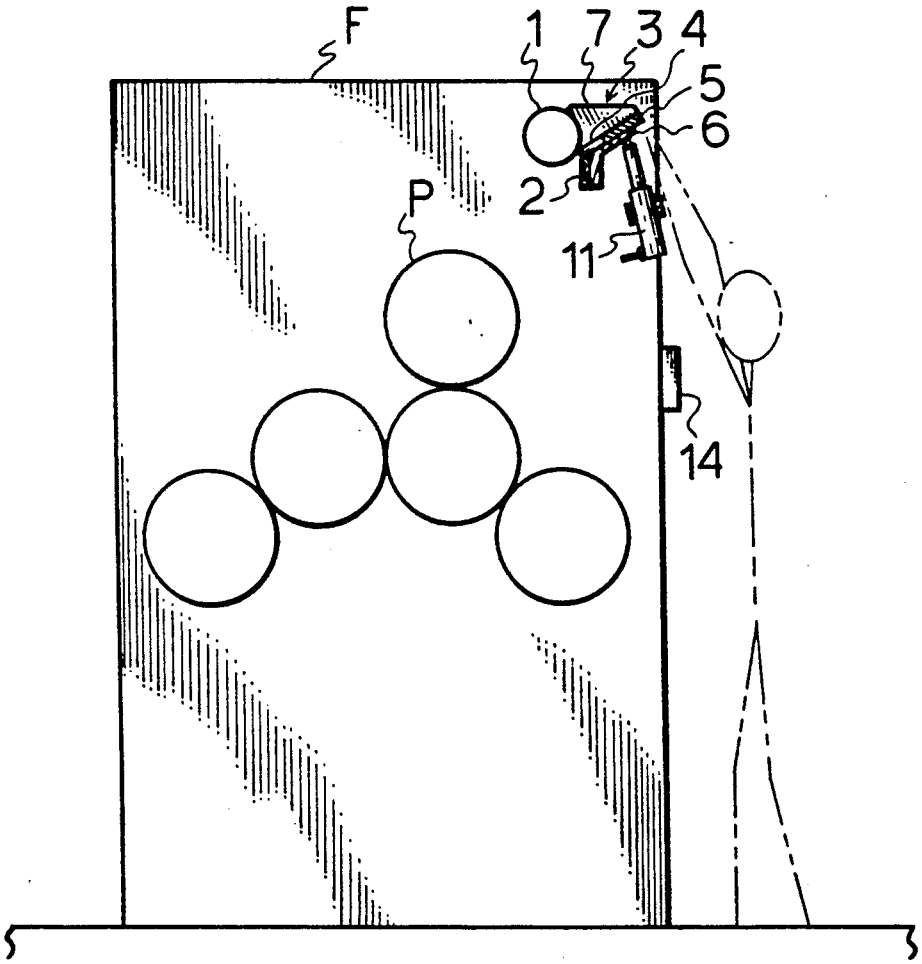
FIG. 3 is an explanatory view showing the position, in which the device of the present invention is mounted on a frame F and in which the position of the worker indicated by the double-dotted lines exemplifies that to be taken when the device of the prior art is operated.

First of all, as shown in FIG. 3, an ink fountain roller 1 is disposed at the starting end of the not-shown ink supply roller groups for supplying a plate cylinder P with ink. The roller 1 has its circumference forming one face of an ink groove 3 having a V-shaped section. The other face of the V-shaped ink groove 3 is defined by an oblique assembly which is composed of a blade 4, a blade support 5 and a base 6.

Figure 1:
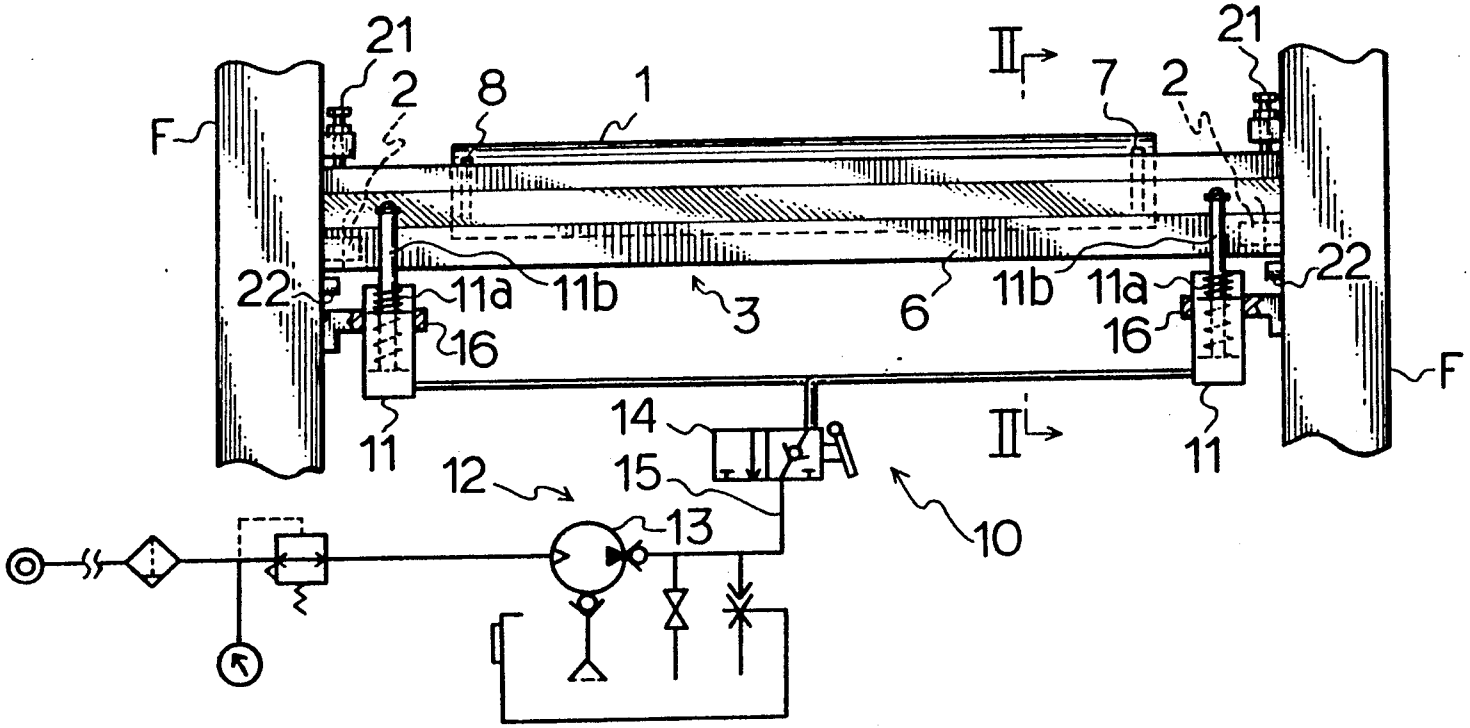
FIG. 1 is a front elevation showing the state in which the ink groove is formed.
Figure 2:
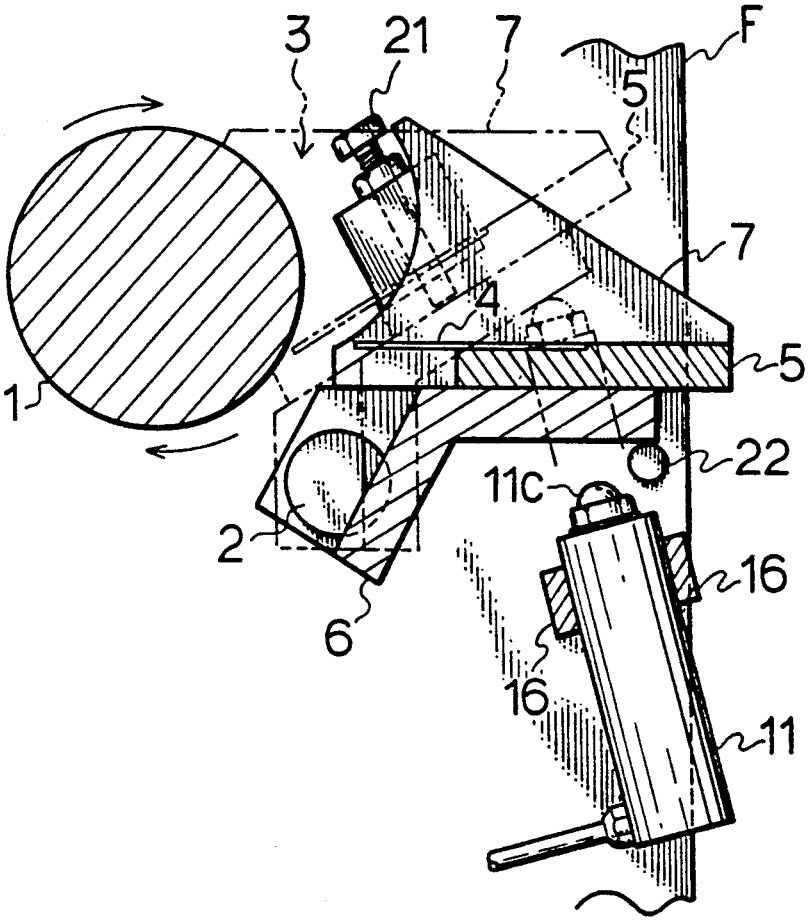
FIG. 2 is an enlarged longitudinal section taken along line II—II of FIG. 1.

As shown in FIGS. 1 and 2, the ink groove 3 has its two ends defined by generally triangular side members 7 and 8 which are projected from the aforementioned oblique assembly toward the circumference of the aforementioned roller 1. As a result, the printing ink is reserved in the groove-shaped reservoir which is defined by the paired side members 7 and 8, the aforementioned oblique members 4, 5 and 6, and the circumference of the aforementioned ink fountain roller 1. The ink thus reserved is gradually sucked out in accordance with the rotations of the roller 1. On the other hand, support pins 2 and 2 are individually projected inward from a pair of side frames F and F to support the two end faces of the bases 6 of the oblique assembly rotatably by the support pins 2 and 2. Upper stoppers 21 and 21 and lower stoppers 22 and 22 are provided on the inner sides of the paired side frames F and F. As a result, the oblique members 4, 5 and 6 are allowed to move to the position, in which the base 6 has its top face abutting against the upper stoppers 21 and 21 (as indicated by double-dotted lines in FIG. 2). In this position, the blade 4 is close to the circumference of the ink fountain roller 1 to form the ink groove 3. On the other hand, the oblique members 4, 5 and 6 are allowed to move to the position, in which the base 6 has its lower face abutting against the lower stoppers 22 and 22 (as indicated by solid lines in FIG. 2). In this position, the blade 4 is apart from the circumference of the ink fountain roller 1.

The oblique members 4, 5 and 6 are turned on the support pins 2 and 2 by drive means 10. This drive means 10 is composed of a driver such as a hydraulic cylinder 11, and pressure supply means such as oil pressure supply means 12 for actuating the drive means 10.

The hydraulic cylinder 11 is so fixed to each of brackets 16 and 16 projecting inward to the inside of the side frames F and F that its rod 11*b* has its leading end directed to the base 6. Incidentally, the leading end of the rod 11*b* may preferably be worked generally into a hemisphere or embedded with a rollable ball 11*c*. This ball 11*c* can roll when it abuts against the lower face of the base 6. A return spring 11*a* is used to retract the rod 11*b*.

The aforementioned hydraulic pressure supply means 12 is equipped with an oil supply pump 13 for applying an oil pressure to the hydraulic cylinder 11, a conduit 15 for connecting the cylinder 11 and the pump 13, and a change-over valve 14 disposed midway of the conduit 15. Of these, the change-over valve 14 may desirably be disposed in such a suitable position as can be easily operated by the worker, as shown in FIG. 3.

Next, the operations will be described in the following.

First of all, when the printing press is run to perform the printing operation, the worker switches the change-over valve 14 to the position shown in FIG. 1. Then, the oil is supplied via the conduit 15 to the inside of the hydraulic cylinder 11 to extend the rod 11*b* against the urging force of the return spring 11*a*. As a result, the ball 11*c* comes into abutment against the lower face of the base 6 of the oblique assembly to bring the oblique assembly 4, 5, and 6 upward, while in rolling contact, to the position in which the upper face of the base 6 abuts against the stoppers 21, as indicated by the double-dotted lines in FIG. 2. By this upward push, the leading edge of the blade 4 comes close to the circumference of the ink fountain roller 1 to form a container acting as the ink groove between the oblique assembly 4, 5 and 6 and the circumference of the ink fountain roller 1. Since the change-over valve 14 is given the function of a check valve, as shown in FIG. 1, the oil pressure supplied to the hydraulic cylinder 11 is held at a proper level so that the oblique assembly 4, 5 and 6 is stably held in the desired position. In this close position, the printing ink is supplied to the plate cylinder as the ink fountain roller 1 rotates.

In case the ink groove 3 is to be cleaned or maintained, the change-over valve 14 is switched to the side opposed to that shown in FIG. 1. Then, the oil pressure is relieved, and the rod 11*b* is retracted by the urging force of the return spring 11*a*. In accordance with this, the oil in the cylinder 11 is returned. As the rod 11*b* is retracted, the oblique assembly 4, 5 and 6 is angularly displaced around the pins 2 and 2 to the position, as indicated by the solid lines in FIG. 2, until it comes into abutment against the lower stoppers 22 and stops. In this stop position, the leading edge of the blade 4 is apart from the circumference of the ink fountain roller 1.

The present invention should not be limited to the embodiment thus far described but should cover all the variations so long as it does not depart from the scope of the claim.

As has been described in detail hereinbefore, according to the present invention, in case the oblique assembly 4, 5 and 6 forming one face of the ink groove 3 is to be brought close to or apart from the circumference of the ink fountain roller 1 so as to perform the ink replacing, cleaning or maintaining operations, it can be automatically turned from a remote place allowing an easy operation. Unlike the prior art, therefore, it is omitted that the worker is obliged to take an unstable position with respect to the position of the ink groove 3 in the printing press or to work in danger for handling the heavy assembly. Thus, the worker is allowed to perform the control operations reliably and easily in a safe position.

What is claimed is:

1. In an ink groove to have its one face defined by the circumference of an ink fountain roller and its other face defined by an oblique assembly, to have a V-shaped section, a device for controlling the width of an ink groove remotely, comprising:

drive means for turning said oblique assembly, between a position for forming said ink groove, when actuated, and another position for forming none of said ink groove;

drive pressure supply means for actuating said drive means remotely;

said drive means includes a cylinder for extending, when supplied with fluid pressure, to bring one side of said oblique assembly into said ink groove forming position, and fluid pressure supply means for supplying said cylinder with said fluid pressure; and said cylinder includes an extendable rod, a ball embedded so rollably in the leading end of said rod as to roll when in contact with said oblique assembly, and a return spring for retracting said rod.

* * * * *